US006033447A

United States Patent [19]

Moock et al.

[11] Patent Number: 6,033,447

[45] Date of Patent: Mar. 7, 2000

[54] START-UP PROCESS FOR A GASIFICATION REACTOR

[75] Inventors: Nathan West Moock, Blountville; William Lewis Trapp, Kingsport, both of Tenn.

[73] Assignee: Eastman Chemical Company, Kingsport, Tenn.

[21] Appl. No.: 08/882,204

[22] Filed: Jun. 25, 1997

[51] Int. Cl.[7] ..... C10J 1/28

[52] U.S. Cl. ..... 48/197 R; 48/202

[58] Field of Search ..... 48/197 R, 202, 48/210

[56] References Cited

U.S. PATENT DOCUMENTS

| | | | |
|---|---|---|---|
| 3,758,037 | 9/1973 | Marion et al. | 239/132.3 |
| 3,816,332 | 6/1974 | Marion | 252/373 |
| 3,945,942 | 3/1976 | Marion et al. | 252/373 |
| 4,353,712 | 10/1982 | Marion et al. | 48/197 R |
| 4,378,974 | 4/1983 | Petit et al. | 48/197 R |
| 4,385,906 | 5/1983 | Estabrook | 48/197 R |
| 4,400,180 | 8/1983 | Marion et al. | 48/197 R |

*Primary Examiner*—Hien Tran

*Attorney, Agent, or Firm*—Matthew W. Smith; Michael J. Blake; Harry J. Gwinnell

[57] ABSTRACT

Coal gasifiers using technology developed by Texaco Development Corporation, use coal slurry and oxygen as feed stocks. During start-ups, the raw gas produced in the gasifier must be flared until the downstream clean-up and recovery plants can be started. In order to reduce emissions through the flare during start-up, a technique was developed to start the gasifiers and downstream plants on a sulfur free, liquid, organic fuel. Once downstream plants are on-line, the fuel feed is switched to coal slurry on the same burner. The switch is accomplished while maintaining pressure and without interrupting to the fuel feed.

8 Claims, 1 Drawing Sheet

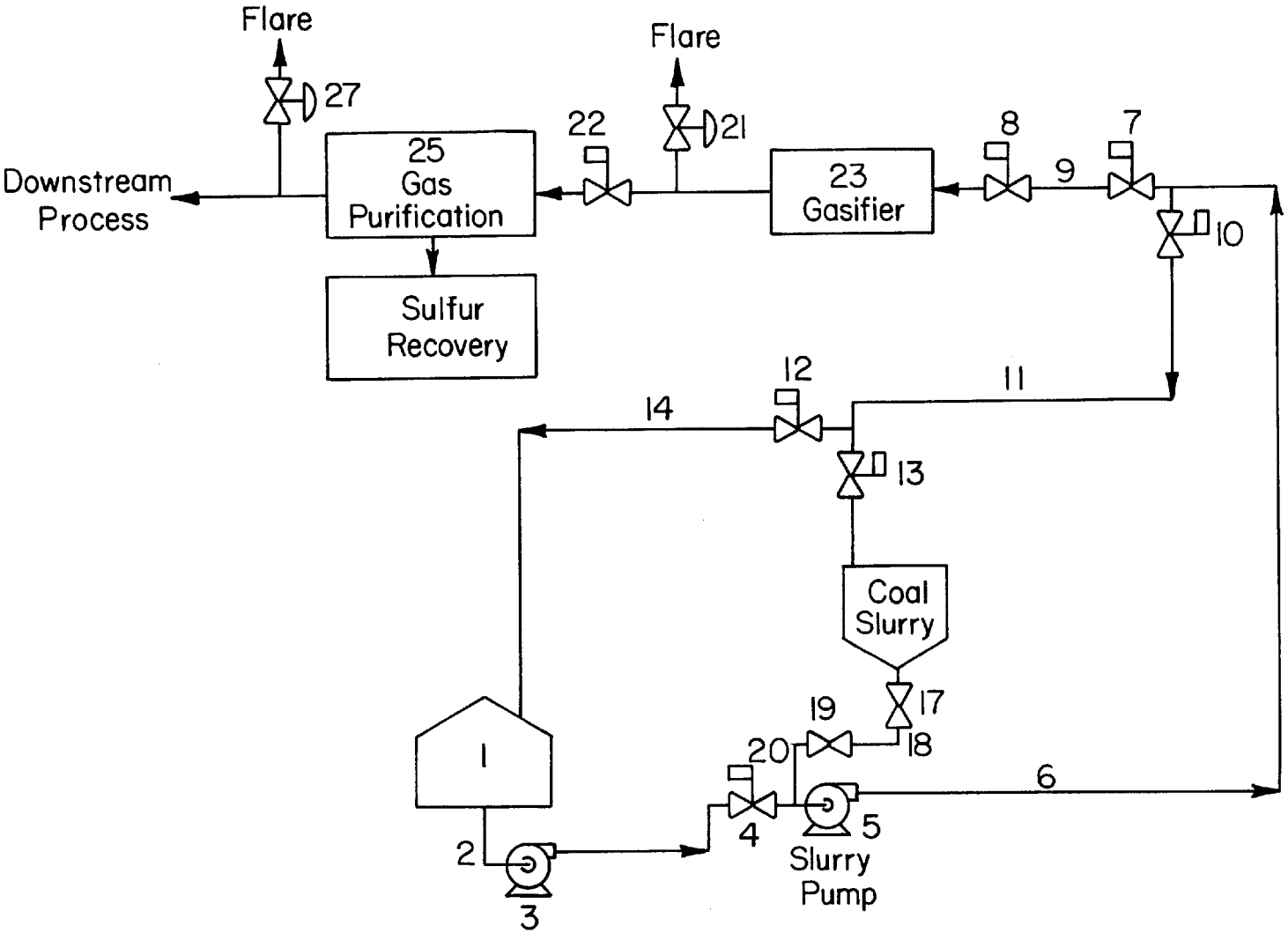
Figure

START-UP PROCESS FOR A GASIFICATION REACTOR

The present invention relates to an improved process for performing start-up of a partial oxidation gas generation system comprising a refractory lined gas generator and a gas purification system. In the improved process of the present invention, a sulfur-free, liquid organic fuel is employed during start-up and pressurizing of the gas generator. As a result, gases normally vented or flared to the atmosphere have reduced levels of contaminants.

BACKGROUND

Various fossil fuels contain components other than hydrogen and carbon, such as sulfur. Combusting such fuels may emit objectionable amounts of gaseous sulfur compounds into the atmosphere. For example, petroleum, coke, coal and heavy residue from hydrocarbon refining processes often contain relatively high contents of sulfur and nitrogen compounds. In addition, some liquid and gaseous fuels contain relatively large amounts of sulfur compounds. Such liquid fuels, while unsuitable for use directly in furnaces, may be processed to remove objectionable components. Solid fuels are generally more difficult to process to remove undesirable sulfur and nitrogen compounds and are less convenient to transport than liquid and gaseous fuels.

It is well known that various carbonaceous fuels (i.e., fossil fuels) may be converted to reducing gas, fuel gas, or synthesis gas (syngas) comprising carbon monoxide and hydrogen by partial oxidation at an elevated reaction temperature and pressure. In these processes, a fossil fuel, such as coal, is reacted with an oxygen-containing gas, usually commercially pure oxygen, in a closed, compact reactor at an autogenous temperature within a range of about 1000° to 1600° C. The reaction zone is usually maintained at a pressure above about 100 pounds per square inch gauge (psig) and may be as high as 3000 psig; usually the process reaction pressures during steady state operation are in the range of 200 to 1200 psig. Steam may be introduced into the reaction zone to assist in the dispersion of fuel in the reactor. Steam also assists in control of the reaction temperature and acts as a reactant thereby decreasing the amount of free oxygen required in the process.

It is also well known that synthesis gas mixtures comprising carbon monoxide and hydrogen are important and useful commercially for a number of reasons. For example, synthesis gas has been used for many years as a source of carbon monoxide in carbonylation reactions. A method for producing such mixtures of gases, which has been used commercially for decades, is by the partial oxidation of sulfur-bearing hydrocarbon fuel; generally, coal in the form of a slurry, which yields a product gas comprising CO, $CO_2$, $H_2$ and $H_2S$.

Fuel burners for producing synthesis gas by partial oxidation of a coal slurry are known. See, for example, U.S. Pat. Nos. 3,758,037 and 3,945,942, which relate to a multitube burner assembly and a process for its use.

The gases produced from gasifying a fossil fuel such as coal may be, and preferably are, further processed to separate them and remove by-products. This is accomplished by gas purification and processing systems known in the art. For example, the product gas from a gasifier may be processed to remove $CO_2$ and $H_2S$ to levels of 1–2 ppm. The removed $H_2S$ may be further processed to convert it to its elemental form in a sulfur recovery plant; the $CO_2$ may also be captured and/or further processed. After removing $CO_2$ and $H_2S$, the remaining gas primarily contains CO and $H_2$ (i.e., syngas). The syngas is most often sent directly to downstream plants for further processing into useful derivatives, such as acetyl chemicals like acetic acid and acetic anhydride.

Under steady state conditions in a typical partial oxidation gas generation plant, the coal gasification process makes syngas and the gas purification system minimizes emissions of contaminants. However, because of the nature of the processes (gas streams instead of liquid, wide temperature extremes, and high pressures), the processes must be started in sequence. The gasifier is started first and must be started instantly at a 50% rate because the burner within the gasifier cannot "turn down" past 50%. Since the product gas from the gasifier cannot be stored, it must be vented and burned at a flare stack until the gas purification process (i.e., the gas clean-up process) can be pressurized, cooled down, and started up.

In a conventional start-up of a partial oxidation gas generating process the gas generator is started at atmospheric pressure after preheating to at least 950° C. Until the gasifier is pressurized and downstream processes brought on-line the resulting effluent, comprising syngas, is burned in a flare. As is well known to those skilled in the art, this results in higher than normal emissions of contaminants such as sulfur. See, for example, U.S. Pat. No. 4,385,906; see also U.S. Pat. No. 3,816,332.

Thus, it is well known to those in the art that start-up of a partial oxidation gas generator presents special challenges, including contaminant emissions. For example, U.S. Pat. No. 4,378,974 to Petit et al. discloses a start-up method for a coal gasification plant, in particular a refractory lined rotary kiln. The method of Petit et al. focuses on the problems that arise from coal having a high chlorine content. In Petit's reactor, the lining is made of materials susceptible to chlorine-induced cracking in the presence of oxygen. Petit starts the reactor up in stages while maintaining an oxygen content in the reactor of a sufficiently low level to prevent chlorine-induced cracking of the refractory lining.

In addition, U.S. Pat. No. 4,385,906 to Estabrook discloses a start-up method for a gasification system comprising a gas generator and a gas purification train. The method of Estabrook isolates and prepressurizes the gas purification train to 50% its normal pressure; the gas generator is then started, and its pressure increased before establishing communication between the generator and the purifier. Purified gases from the purifier may then be burned in a flare until all parts of the process reach appropriate temperature and pressure.

We have found that air contaminants, such as sulfur, which are characteristic of start-up, may be eliminated by starting the gasifier on a sulfur-free, liquid organic fuel. In our unique process, a gasifier is started using a sulfur-free liquid organic fuel; once the appropriate conditions of temperature and pressure are attained in the gasifier and gas purification systems, the burner is transitioned to a carbonaceous fossil fuel slurry.

A number of factors must be considered before determining the appropriate liquid to use in the improved process for starting a partial oxidation gas generator. Those considerations included:

1. Fuel Considerations
   a) oxygen to fuel ratio must be similar (on volume basis) as that present when the coal slurry is fed to the gas generator.
   b) Resulting gas composition should have similar $CO/H_2/CO_2$ ratios so that downstream plants can operate within their designed parameters.

c) The liquid fuel should be compatible with slurry since both will use common equipment during transition.

d) The liquid fuel should be "clean" and free of substances that are not normally present such as high concentrations of metals.

e) Atomization differences between the two fuels on the same burner.

f) Gasifier dynamics such as flame temperature, refractory wear, pressure build-up.

g) Fuel availability, cost, health and safety hazards.

2. How to transition from liquid fuel to slurry without interrupting the feed system.

3. How to start-up sulfur recovery plant at low $H_2S$ concentrations before the system is lined out.

As set forth in more detail below, the sulfur free liquid organic fuel may be a hydrocarbon compound of 1 to 20 carbons.

It is an object of the present invention to provide a process for start-up of a partial oxidation gas generator that minimizes contaminants such as sulfur.

It is a further object of the invention to provide a start-up procedure that does not require raw syngas derived from a fossil fuel to be flared and vented to the atmosphere.

It is also a further object of the invention to provide an alternative process for preheating a partial oxidation gas generator that does not require a natural gas source.

BRIEF DESCRIPTION OF THE DRAWINGS

The attached FIGURE sets forth an embodiment of an apparatus and equipment for use in the present invention.

SUMMARY OF THE INVENTION

A process for starting up a partial oxidation gas generation system comprising a refractory-lined pressurized gas generator and a gas purification system which comprises the steps of:

a) preheating the gas generator;

b) introducing a sulfur-free liquid organic fuel and an oxygen-containing gas into the preheated gas generator;

c) allowing the pressure inside the gas generator to reach a pressure of 100 to 3000 psig, and the temperature to reach 1000° to 1600° C.;

d) diverting a product gas comprising CO and $H_2$ produced in the gas generator to the gas purification system; and e) replacing the sulfur-free liquid organic fuel with a carbonaceous fuel.

As will be discussed below, the process may also be used to preheat the gas generator (i.e., step a) above) with the sulfur-free liquid organic fuel. Further, the process may be employed when more than one partial oxidation gas generator is present.

DETAILED DESCRIPTION OF THE INVENTION

In a conventional start-up of a partial oxidation gas generation process, the gas generator is first preheated to ensure the integrity of the refractory lining upon start up and during operation. The gas generator is then started up at atmospheric pressure and the resulting effluent gas from the gas generator burned in a flare. Once the gas generator is pressurized and operating satisfactorily, the flow of gases from the gas generator is diverted to the gas purification system, and eventually to downstream processes once the purification system is fully pressurized. As the pressure in the system increases, the volume of gases passing from the gas generator to the gas purification system may be increased until full pressure and throughput conditions are reached.

Likewise, if there are downstream processes that will use product gas from the purifier, those processes must be pressurized as well; until downstream processes are pressurized, and normal flows and equilibria established, purified syngas is vented and flared at the purifier. It will be understood that the product gas is normally burned at the flare only during the startup period.

More specifically, the start-up requires that the gas generator's reaction zone first be preheated to a temperature of about 950° to 1300° C. at substantially atmospheric pressure. Preheating is accomplished by burning a clean fuel gas, most typically natural gas (methane), with an oxygen containing gas; the products of this combustion (carbon dioxide and water) are vented to the atmosphere.

Usually, the preheating operation requires use of a rather simple burner suited to the methane fuel. Once the gasifier is preheated, the natural gas burner must be removed and the coal slurry burner introduced into the gas generator prior to start-up; at least some temperature loss is inevitable because of this change over. It should be understood, that the sulfur-free, liquid organic fuel may also be employed to preheat the gasifier. This would accomplish at least two things: eliminate the need for a source of natural gas and eliminate the extra step of changing burners between preheating and start up.

In a conventional start-up, a carbonaceous fuel such as coal slurry is fed to the reactor with an oxygen containing gas; the mixture immediately ignites in the high temperature environment. Under the process of the present invention, a sulfur-free, liquid organic fuel rather than a coal slurry is introduced into the gas generator once the generator is preheated and the burners changed.

As noted above, we have discovered that start-up emissions may be eliminated by starting the gasifier on a sulfur-free, liquid organic fuel. In our unique process, a gasifier is started using a liquid fuel that does not contain sulfur; once the appropriate conditions are attained in the gasifier and gas purification systems, the burner is transitioned to coal slurry.

The appropriate liquid fuel may broadly be described as a liquid hydrocarbon compound, or a mixture of such compounds, free of sulfur and having 1 to 20 carbon atoms, preferably 1 to 12 carbon atoms. For example, the hydrocarbon compound may be an alcohol, preferably an aliphatic alcohol of 1 to 12 carbon atoms such as methanol, ethanol or propanol. Among aliphatic alcohols, propanol is preferred; and most preferably n-propanol.

In addition, a relatively clean organic waste or low value stream (i.e., that results from other processes) that is free of sulfur, has 1 to 20 carbon atoms, and that is compatible with a water/coal slurry may serve as an alternative. Waste or low value streams that are outside of these criteria are also possible, but have more risk and will require a more cautious testing program.

Referring now to the FIGURE, once the gas generator has been preheated, the sulfur-free, liquid organic fuel is fed to the gas generator. For purposes of the following description, the sulfur free liquid organic fuel will be propanol (for example, n-propanol). The propanol is fed from tank 1 through line 2 to centrifugal pump 3, and through remotely operated valve 4. Pump 5 is a specialized, positive displacement pump designed to pump coal slurry. Prior to and during start-up, propanol is pumped through valve 4 and through pump 5 and into line 6. Before propanol is introduced into the generator (i.e., during preheating), it is circulated back to tank 1 to establish flow in the lines. Thus, remotely operated valves 7 and 8 on line 9 are closed so that the propanol is diverted into line 11 via valve 10. Further, valve 13 is closed so that the propanol is sent through valve 12 and into line 14, and finally back into tank 1.

Once the generator is preheated, the burners changed, and the circulation of the propanol established, valves 7 and 8 are opened, and valve 10 closed, allowing propanol to flow through line 9 and into gas generator 23 where it is mixed with oxygen and burned. The resulting effluent gas, as noted above, is vented and flared at valve 21. Under the process of the present invention, unlike processes known in the art, the flared gas is free from pollutants that are characteristic to fossil fuels (i.e., sulfur).

Almost immediately after the propanol fuel is ignited, flare valve 21 is restricted and pressure built up within the gas generator to the desired level. At full pressure within the gas generator, the gas is slowly diverted from flare valve 21, to valve 22, into the gas purification process 25 and out flare valve 27. This is continued until flare valve 21 is completely closed. The product vented and flared at the purification system at valve 27 is substantially comprised of clean syngas. Once valve 21 is completely closed, the propanol feed is switched to coal slurry. Thus, valves 17 and 19 are opened and coal slurry allowed to pass through lines 18 and 20 and into pump 5 with propanol; consequently, valve 4 is closed off. For a short time, the lines leading to the gas generator contain both propanol and coal slurry. The coal slurry then passes through lines 6 and 9 and into the gas generator, which burns the coal slurry in place of the propanol start-up feed. Once the fuel has changed from propanol to coal slurry, the oxygen flow is adjusted to match the required amount for coal slurry. When the downstream processes are brought on line, the product gases are no longer flared through valve 27.

The gasifier start up process normally takes 2–4 hours, but can take longer if the coal gasification process (i.e., the facility) has been down for a long time.

A sulfur recovery plant, which may be placed downstream of the gas purification system, must start-up on natural gas only. After the purifier is on line and fully operating, the operator must slowly reduce the flow of natural gas, increase the sulfur-containing process gas from the purifier and adjust the amount of air fed into the recovery plant as the concentration of the $H_2S$ builds.

In a particular embodiment of a gasifier process, the gasifier uses a "three-stream" burner, having oxygen in the center, coal slurry in an annulus surrounding the oxygen, and oxygen again in an outer annulus. An example of a coal that may be used typically originates in Southwest Virginia or Kentucky, which has a sulfur content of approximately 2.5%. Coal of any origin may be used, but it is generally preferable that the coal have a low melting point, high carbon content and low ash content. The gasifier is typically operated during steady state at about 1400° C. and about 1,000 psig pressure. The product gas is cooled to near ambient temperature and sent to downstream processing, including purification (to remove $CO_2$ and $H_2S$) and sulfur recovery. The cleaned syngas is then further processed in reactions for which syngas serves as a raw material.

The process of the present invention may also be used when more than one gasifier is present. Occasionally, a new gasifier is started before the old one is shut down, which is called a gasifier "switch." During a switch, the flow of product gasses to the downstream processes remains uninterrupted. The basic procedure described above is the same except for the following: the new gasifier is started on propanol and pressurized as described above; the old gasifier (rates reduced, but still on line and burning coal slurry) is then switched to propanol. Flare valves are switched so that the output of the old gasifier is being flared and the new one is brought on line (i.e., all output from the new gasifier is being sent to the purifier). The old gasifier is then shutdown. The new gasifier is then switched to slurry.

The invention has been described in detail with particular reference to preferred embodiments thereof, but it will be understood that variations and modifications will be effected within the spirit and scope of the invention.

We claim:

1. A process for reducing contaminant emissions during start-up in a partial oxidation gas generation system comprising a refractory-lined pressurized gas generator, a gas purification system, and a sulfur recovery system which comprises the steps of:

a) preheating the gas generator to a temperature of at least 950° C. by feeding a mixture comprising a sulfur-free liquid organic fuel and an oxygen containing gas to the gas generator and combusting said mixture within the gas generator to produce a sulfur-free product gas comprising CO and $H_2$;

b) feeding said sulfur-free product gas to a flare;

c) restricting the flow of said sulfur-free product gas to said flare to pressurize the gas generator to 100 to 3000 psig, and to achieve a temperature of 1000° to 1600° C. in the gas generator;

d) diverting said sulfur-free product gas produced in the gas generator to the gas purification system;

e) feeding natural gas and air to the sulfur recovery system to start the sulfur recovery system;

f) feeding into said gas generator a carbonaceous fuel containing sulfur along with said sulfur-free liquid organic fuel and oxygen to produce a sulfur-containing product gas;

g) feeding said sulfur-containing product gas from step f) into the gas purification system;

h) feeding said sulfur-containing product gas from step g) into the sulfur recovery system;

i) terminating the feed of natural gas to the sulfur recovery system and adjusting the amount of air fed to the sulfur recovery system; and j) terminating the feed of said sulfur-free liquid organic fuel to said gas generator.

2. A process according to claim 1 wherein the sulfur-free liquid organic fuel is an alcohol of 1 to 12 carbon atoms.

3. A process according to claim 1 wherein the alcohol is an aliphatic alcohol.

4. A process according to claim 3 wherein the alcohol is propanol or n-propanol.

5. A process according to claim 1 wherein the carbonaceous fuel is a coal slurry.

6. A process according to claim 1 wherein the sulfur-free liquid organic fuel is an aliphatic alcohol of 1 to 12 carbon atoms.

7. A process according to claim 6 wherein the alcohol is propanol or n-propanol and the carbonaceous fuel is a coal slurry.

8. A process for reducing contaminant emissions during start-up in a partial oxidation gas generation system comprising a refractory-lined pressurized gas generator, a gas purification system, and a sulfur recovery plant which comprises the steps of:

a) inserting a gas burner into a gas generator;

b) feeding a sulfur-free gas to said gas burner;

c) combusting said sulfur-free gas within said gas generator to preheat said gas generator to a temperature of at least 950° C.;

d) replacing said gas burner with a coal slurry burner;

e) feeding a mixture comprising a sulfur-free liquid organic fuel and an oxygen containing gas to said coal slurry burner in said preheated gas generator;

f) combusting said mixture to produce a sulfur-free product gas comprising CO and $H_2$;

g) feeding said product gas from step f) to a flare;

h) restricting said feed of said product gas to said flare to achieve a pressure inside the gas generator of 100 to 3000 psig, and a temperature of 1000° to 1600° C.;

i) feeding said product gas from said gas generator to the gas purification system;

j) terminating said feed of said product gas to said flare;

k) feeding into said gas generator a carbonaceous fuel containing sulfur along with said sulfur-free liquid organic fuel and oxygen to produce a sulfur-containing product gas comprising CO and $H_2$;

l) feeding natural gas and air to the sulfur recovery system to start the sulfur recovery system;

m) feeding said sulfur-containing product gas from step k) into the gas purification system;

n) feeding said sulfur-containing product gas from step m) into the sulfur recovery system;

o) terminating the feed of natural gas fed to the sulfur recovery system and adjusting the amount of air fed to the sulfur recovery system; and p) terminating the feed of said sulfur-free liquid organic fuel to said gas generator.

* * * * *